United States Patent [19]

Nickence

[11] 4,367,007

[45] Jan. 4, 1983

[54] HOUSING FOR CUBE TAP ELECTRICAL CONNECTOR

[75] Inventor: John Nickence, Montgomery, Ill.

[73] Assignee: Belden Corporation, Geneva, Ill.

[21] Appl. No.: 159,297

[22] Filed: Jun. 13, 1980

[51] Int. Cl.[3] ..... H01R 13/506; H01R 21/08

[52] U.S. Cl. ..... 339/210 M; 339/157 C

[58] Field of Search ..... 339/157 R, 157 C, 159 C, 339/208, 210 M

[56] References Cited

U.S. PATENT DOCUMENTS

| | | | |
|---|---|---|---|
| 3,439,315 | 4/1969 | Hamel et al. | 339/157 X |
| 4,029,896 | 6/1977 | Skinner | 339/208 X |
| 4,033,658 | 7/1977 | Asick | 339/210 M X |

FOREIGN PATENT DOCUMENTS

| | | | |
|---|---|---|---|
| 581006 | 8/1959 | Canada | 339/159 C |

*Primary Examiner*—Eugene F. Desmond

*Attorney, Agent, or Firm*—Fitch, Even, Tabin, Flannery & Welsh

[57] ABSTRACT

An improved electrical cube tap connector of the type having multiple plug-in receptacles, a housing for the connector being formed from generally similar sections adapted for interlocking engagement in pairs, each section forming spaced-apart slots on a face surface for receiving electrical contact strips, elongated projecting detent elements and recesses being formed on opposite sides of the face surface for interlocking engagement of the housing sections, projecting and recessed alignment means being symmetrically arranged on the face surface for cooperation with the detent components to assure that the housing sections remain in interlocked alignment, the housing sections each being formed with one or more sets of openings for receiving plug-type connectors.

2 Claims, 4 Drawing Figures

HOUSING FOR CUBE TAP ELECTRICAL CONNECTOR

The present invention relates to electrical cube tap connectors of the type having multiple plug-in receptacles or outlets and more particularly to such a connector including a housing formed from similar, symmetrically interlocking sections.

Electrical connectors of the type contemplated by the present invention are commonly employed to provide multiple plug-in receptacles for receiving one or more electrical plugs. Electrical contact strips arranged within the connector are interconnected with an electrical line or cord to provide a connection receptacle for electrical appliances or the like.

A preferred configuration for such an electrical cube tap connector includes spaced-apart openings at opposite ends of one housing section of the connector for receiving polarized or unpolarized plug-type connectors, a single set of openings being centrally arranged upon the other housing section in order to provide three spaced-apart plug-in receptacles. However, it will be apparent from the following description that the present invention is not limited to a cube tap connector having this specific arrangement of receptacles.

It is particularly important to provide a relatively simple and rapid means for assembling such a cube tap connector. For example, such connectors are commonly purchased separately from the electrical cord and interconnected by the user. Accordingly, it is desirable that the connector be of simple construction in order to facilitate assembly. At the same time, it must be kept in mind that the connector is exposed to substantial stresses when plug-type connectors are inserted into and removed from the receptacles of the connector which must therefore be suitable for resisting such stresses and preventing accidental misalignment or separation of the connector components.

Accordingly, there has been found to remain a need for an improved electrical cube tap connector having a housing designed to facilitate assembly of the connector and to assure that the connector remains in proper assembled order during use.

SUMMARY OF THE INVENTION

It is therefore an object of the invention to provide an improved electrical connector having a housing formed from similar interlocking housing sections.

It is more particularly an object of the invention to provide a cube tap connector having housing sections of the type referred to above which are molded with substantially similar configurations to facilitate and simplify both manufacture of the housing components and assembly of the connector.

Housing elements for electrical components have been formed from similar elements in the past. For example, reference may be had to U.S. Pat. No. 4,029,896 issued June 14, 1977 for a Terminal Housing for an Electrical Resistance Heater. However, it is to be noted that such a housing is for a substantially different application than that contemplated by the present invention. In particular, in the present invention, the housing must resist stresses developed during the insertion and removal of plug-type connectors from the plug-in receptacles of the cube tap connector. Accordingly, the housing of the cube tap connector of the present invention must be adapted to withstand such stresses in order to assure that the housing remains in proper assembled condition during use.

Stresses of the type referred to above are preferably withstood by providing symmetrically offset detent projections and recesses which extend along a substantial length of the housing and even more preferably interact with alignment means arranged upon the housing sections in order to assure that the housing sections remain in interlocked engagement.

Additional objects and advantages of the present invention are made apparent in the following description having reference to the accompanying drawing.

DESCRIPTION OF THE PREFERRED EMBODIMENT

Figure 3:
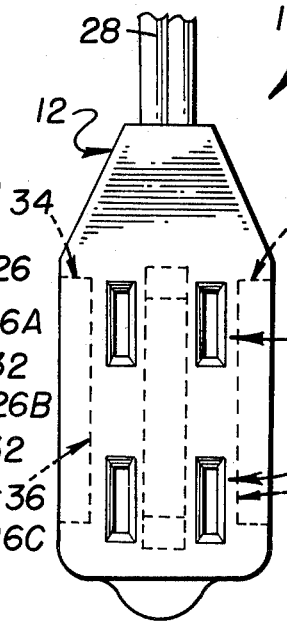
FIG. 3 is a similar plan view of a completely assembled cube tap connector constructed in accordance with the present invention by joining the housing sections of FIGS. 1 and 2.
Figure 4:
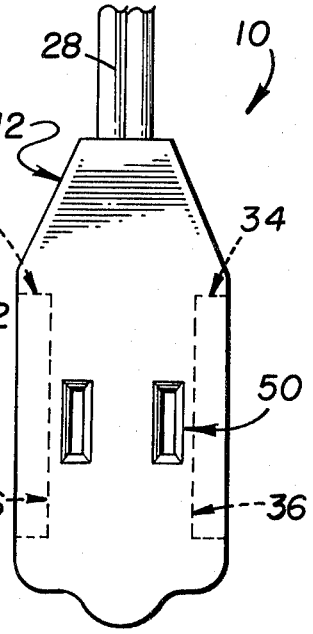
FIG. 4 is a plan view of the other side of the cube tap connector of FIG. 3.

A cube tap connector of the type contemplated by the present invention is illustrated for example at 10 in completely assembled fashion in FIGS. 3 and 4. The connector preferably includes a housing 12 formed from a first housing section 14 best illustrated in FIG. 1 and a similar housing section 16 for completing assembly of the connector 10. Components and features of the housing section 16 which are similar to features of the housing section 14 are indicated by corresponding primed numerals.

The housing sections 14 and 16 are of similar configuration and include detent means as will be described in greater detail below for permitting the sections 14 and 16 to be rapidly assembled into the single unitary housing 12. Accordingly, details of the first housing section 14 are described immediately below and it is to be noted that the other housing section 16 is of substantially similar configuration primarily with the exception of the plug-in type connector openings and alignment means.

Figure 1:
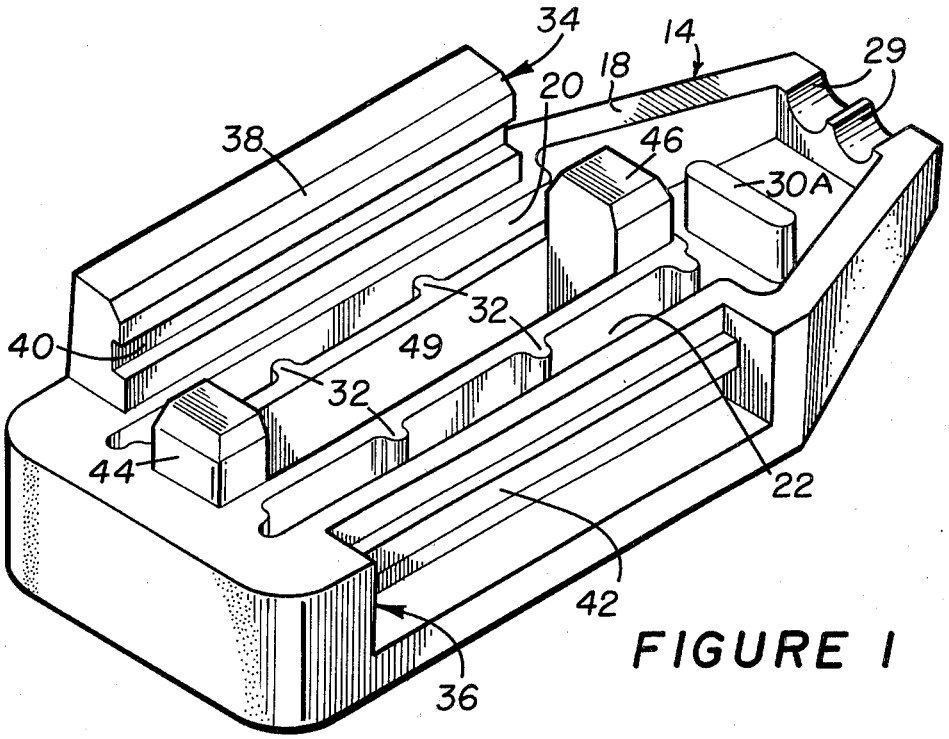
FIG. 1 is a perspective view of a single housing section of the type contemplated by the present invention for use in a cube tap connector.
Figure 2:
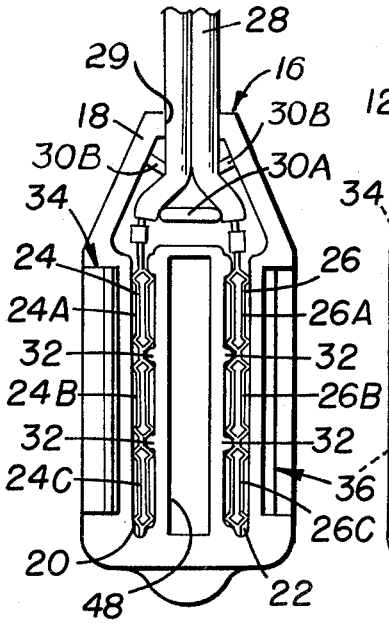
FIG. 2 is a plan view of another housing section adapted to mate with the housing section of FIG. 1 and illustrating electrical contact strips and electrical line or cord arranged in place.

Referring now specifically to FIGS. 1 and 2, the first housing section 14 is formed with a substantially flat face surface 18 arranged for engagement with the other housing section 16. A pair of spaced-apart slots 20 and 22 are symmetrically arranged upon the face surface of the housing section 14 and are of suitable dimension for receiving electrical contact strips 24 and 26 interconnected with a single electrical line or cord 28. The electrical contact strips 24 and 26 are of conventional design and form pressure contacts for receiving plug-type connectors (not shown) in three locations indicated respectively at 24A, 24B, and 24C as well as 26A, 26B and 26C. The housing section is formed with an inlet 29 and projections 30 for guiding the respective split portions of the cord 28 into the slots 20 and 22 and for preventing displacement of the contact strips 24 and 26 upon movement of the cord 28 relative to the assembled housing 12. Central projections 30A are formed in mating alignment on the respective housing sections 14 and 16. Angled projections 30B are formed on each side of the inlet 29 on the housing section 16 and extend above its face surface 18 in order to project into the other housing section 14. Ribbed projections 32 are formed along the side walls of the spaced-apart slots 20 and 22 in order to assist in maintaining proper positioning of the electrical contact strips 24 and 26.

The interlocking configuration for the housing section 14 is provided by means of a projecting detent element 34 arranged on one side of the face surface 18 and a mating recess 36 arranged along the opposite side of the face surface 18. Preferably, the projecting detent element 34 is formed as an elongated tab 38 having an inwardly facing slot or recess 40. At the same time, the detent recess 36 preferably forms an elongated flange 42 adapted for locking engagement with the recess 40 of a mating housing section. The detent element 34 and recess 36 are preferably of substantial length and of about the same length as the slots 20 and 22 in order to better resist stresses developed in the connector housing during use.

Alignment means 44 and 46 are also arranged upon the face surface of the housing section 14 in order to assure proper alignment of the housing sections 14 and 16 while they are interlocked to form a connector. Preferably, the alignment means 44 and 46 are formed as rectangular projections positioned on the housing section 14 generally adjacent opposite ends of the detent element 34 and recess 36 to extend into mating engagement with opposite ends of an elongated cavity 48 in the housing section 16 in order to assure that the housing sections 14 and 16 remain in interlocked and aligned engagement during use.

The detent recess 36 is formed as an integral portion of the housing section 14. At the same time, the projecting detent element 34 is also preferably formed as an integral portion of the housing section 14 and may be cast at the same time from a suitable electrically insulating material. Preferably, the material is slightly flexible in order to facilitate interlocking of the detent flange 42 with the slot 40.

The housing section 14 is also formed with a central cavity 49 which, like the cavity 48, serves to reduce the weight and mass of the assembled housing. At the same time, the cavities 48 and 49 reduce the amount of material necessary for forming each of the housing sections.

Within an assembled cube tap connector, each housing section may be formed with one or more sets of openings for receiving plug-type connectors as referred to above. Preferably, referring to FIG. 4, the housing section 16 is formed with a single pair of openings 50 arranged in alignment with the slots 20 and 22 and centrally arranged upon the assembled connector for receiving one plug-type connector. Similarly, the other housing section 14 is formed with two pairs of openings 52 and 54 also in alignment and communication with the slots 20 and 22 while being arranged toward opposite ends of the connector. Thus, the cube tap connector illustrated in FIGS. 3 and 4 is adapted for receiving three different plug-type connectors. The arrangement of the openings 50, 52 and 54 upon the housing sections may be provided for during molding by use of conventional inserts (not shown) as are well known in the prior art. As noted above, the receptacles 50, 52 and 54 may also be of either polarized configuration. Preferably the housing sections 14 and 16 may also be formed with safety cover plates for selectively covering the receptacles 50, 52 and 54 or exposing them for use. Such a cover plate is illustrated for example in U.S. patent application, Ser. No. 79,716, filed Sept. 28, 1979, now U.S. Pat. No. 4,279,457, issued July 21, 1981, by the inventor of the present invention and assigned to the assignee of the present invention. However, such cover plates are not shown in FIGS. 3 and 4 in order to better illustrate construction according to the present invention.

In order to assemble a cube tap connector of the type contemplated by the present invention, the electrical contact strips 24 and 26 are arranged within one of the housing sections, for example that illustrated at 16 in FIG. 2. With the contact strips in place, the other housing section 14 may then be arranged in place with the alignment means 44 and 46 assuring proper alignment of the housing sections, the flanged, detent element 34 of each housing section engaging the detent recess of the other housing section in order to firmly secure the housing sections together and form the single housing 12 for the connector 10.

Various modifications are of course possible for the cube tap connector of the present invention in addition to those specifically described above. Accordingly, the scope of the present invention is defined only by the following appended claims.

What is claimed is:

1. An electrical connector comprising: contact strips defining at least three socket means for receiving at least three plug-type connectors, and a housing formed by transversely opposed interlocking sections, one of said sections having at least one pair of openings in communication with two spaced-apart slots for transversely receiving a plug-type connector, the other of said sections being formed with at least two pairs of openings in communication with two spaced-apart slots for transversely receiving up to two plug-type connectors, each section having:

(a) a surface extending generally longitudinally and laterally and adapted to lie in face contact with the corresponding surface of said other section, (b) two laterally spaced, longitudinally extending slots for receiving respective of said contact strips therein, (c) inlet means formed at one longitudinal end of said section for communication with both slots, (d) a longitudinally extending cavity situated between said slots, (e) a tab located along one lateral side of said section and extending transversely from said surface, said tab being elongated longitudinally, said longitudinal tab extending substantially parallel to said cavity and having a length at least equal to said three socket means, said tab having along a transverse extremity a detent projecting laterally therefrom and being partially formed by a groove in the transverse surface of said tab, and (f) a complementary recess formed along the other lateral side of said section and extending transversely from said surface, said recess being elongated in a longitudinal direction, said longitudinal recess extending substantially parallel to said cavity and having a length at least equal to said three socket means, said recess defining a detent-receiving portion by having (i) an inner ledge formed by a longitudinally extending flange having an upper surface so as to cooperate in face contact with the detent of the other of said sections and having a lower surface to lie in face contact with the corresponding surface of said groove to provide locking engagement of said sections against transverse relative motion upon assembly of said housing, and (ii) an outer ledge formed to cover and obstruct access to the distal end of said tab of said other of said sections and all of said detent thereon upon assembly of said housing; one of said sections having a pair of alignment pins located at opposing longitudinal ends of its cavity for insertion into the ends of the cavity of the other of said sections providing for the alignment of said sections upon assembly of said housing, said alignment pins being located and formed so as to prevent rotational, lateral and longitudinal movement of one of said sections relative to the other subsequent to assembly of said housing.

2. The connector of claim 1 further characterized in that each of said slots has ribbed projections to properly position said electrical contact strips therein.

* * * * *